United States Patent [19]

Fairbairn

[11] 4,186,329

[45] Jan. 29, 1980

[54] ELECTRICAL POWER SUPPLIES

[75] Inventor: Ian A. Fairbairn, Maidenhead, England

[73] Assignee: EMI Limited, Hayes, England

[21] Appl. No.: 900,597

[22] Filed: Apr. 27, 1978

[30] Foreign Application Priority Data

Apr. 29, 1977 [GB] United Kingdom ..... 17977/77

[51] Int. Cl.[2] ..... G05F 1/62

[52] U.S. Cl. ..... 315/241 R; 315/287; 315/307; 320/1; 323/22 R

[58] Field of Search ..... 315/241 R, 287, 291, 315/307; 250/402, 418; 320/1; 323/18, 22 R, 93

[56] References Cited

U.S. PATENT DOCUMENTS 3,541,420 11/1970 Rees ..... 320/1

3,983,473 9/1976 Sanderson ..... 323/22 R

*Primary Examiner*—Eugene R. LaRoche

*Attorney, Agent, or Firm*—Cooper, Dunham, Clark, Griffin & Moran

[57] ABSTRACT

An electrical power supply for an X-ray tube has a source capable of providing constant current at a desired potential to a capacitor means which supplies pulses of current in excess of the source current to the X-ray tube. As each pulse is supplied, the potential at the output of the supply tends to drop. One side of the capacitor means is connected to the output. A compensator is connected to the other side of the capacitor means and responds to a drop in the output potential to apply to the other side of the capacitor means a voltage which maintains the output voltage constant.

5 Claims, 3 Drawing Figures

ELECTRICAL POWER SUPPLIES

The present invention relates to electrical power supplies and it relates especially to such supplies for supplying high potential, high current pulses to an X-ray generating tube.

In a branch of medical radiography which has become known as computerised tomography, X-radiation is projected through a cross-sectional slice of a patient's body from many locations distributed around, and externally of, the slice. Radiation emergent from the slice is detected and the detected radiation values in respect of all of said locations are processed to produce a representation of the variation of absorption (or transmission) of the radiation over the slice.

The source of the X-radiation may be physically scanned about the slice in rotational, and often also translational manner. In either event, such physical scanning renders difficult examination of a patient in a time so short that organs of the patient's body, or air or fluid within the body cannot have effected noticeable motion. It is desirable to be able to scan a patient in such a short time (e.g. 0.1 second) in order that the representations of body slices intersecting or lying adjacent a highly mobile body organ, such as the heart, can be produced with accuracy.

It has been proposed to perform the scanning at high speed by techniques involving the use of an X-ray tube which, for example, is of toroidal form and has a substantially circular anode which which completely encircles the patient's body. The anode is caused to emit radiation from various regions around its circumference so as to irradiate the body from many directions.

According to the invention there is provided an electrical power supply including: a source for supplying electrical energy at a constant current and at a desired potential; capacitor means, connected to the source to be charged therefrom, for supplying a pulse, having a predetermined duration, of electrical energy at a rate in excess of the rate of supply by the source; an output terminal, connected to one side of the capacitor means, to which the pulse is supplied; and compensating means connected to the side of the capacitor means remote from the output terminal and responsive during the supply of the pulse to a drop in the voltage at the output terminal below a reference level to apply to the said side of the capacitor means remote from the output terminal a compensating voltage which varies oppositely to the variation in voltage across the capacitor means to maintain the voltage at the output terminal substantially constant during the supply of the pulse.

Figure 1:
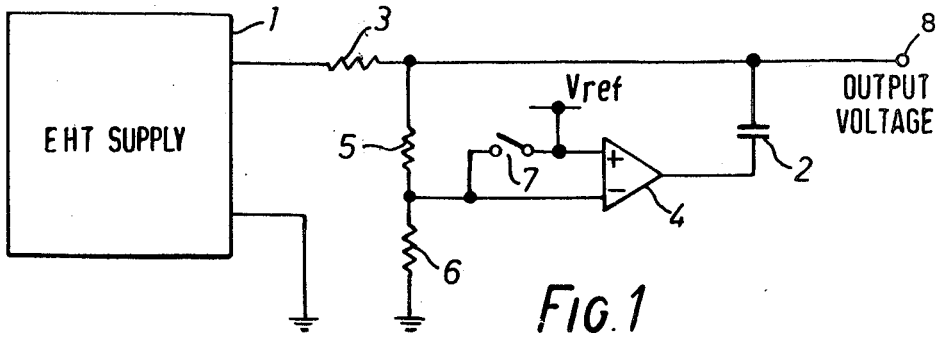
Figure 2:
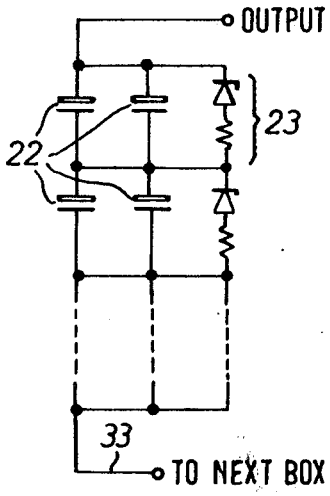
Figure 3:
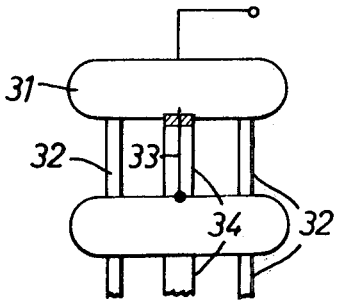

In order that the invention may be clearly understood and readily carried into effect, one embodiment thereof will now be described, by way of example only with reference to the accompanying drawings of which:

FIG. 1 shows a schematic circuit diagram of a supply in accordance with one example of the invention, FIG. 2 shows inter-connections between individual ones of an array of capacitors, and FIG. 3 shows a layout of capacitors which reduces corona discharge effects.

Referring to FIG. 1, a conventional X-ray EHT supply 1, for example the PANTAK R.F. power supply which can provide up to 40 mA at a potential adjustable between 8 and 80 kV, charges a capacitor means 2 through a ballast resistor 3 and the (low) output resistance of an amplifier 4. If the power supply is operated at 30 milliamps then it takes approximately three seconds to make good a discharge of one ampere lasting 0.1 seconds. The capacitance of the capacitor means 2 is chosen so that the EHT drops by less than 10 kV, say during the 0.1 second exposure time.

During the exposure time the amplifier 4, which is a differencing amplifier fed by current bled from the supply 1 via a potential divider 5, 6 provides one amp (or whatever the load current is) at a voltage appropriate to keep the output voltage substantially constant. In other words, it generates a ramp voltage to compensate for the voltage drop with time across the capacitor means 2. The ramp voltage is produced because the divider 5, 6 senses the voltage at the output 8, which falls with the voltage across the capacitor means 2. The amplifier amplifies the difference between the (falling) voltage sensed by the divider and a reference voltage V reference when the capacitor means is discharging to produce the ramp voltage. After the exposure, (or discharge of means 2) the output of the amplifier 4 is forced to zero volts by circuits such as a switch 7 which is closed to connect equal signals to the two input terminals of amplifier 4, and the conventional supply 1 tops up the capacitor means 2 through resistor 3 ready for the next exposure. Re-opening switch 7 just prior to the exposure puts the amplifier in overall control again.

The principal can be extended to compensate errors in the amplifier using a further lower voltage amplifier.

It is convenient to operate the supply 1 at a rating of about +72 kV and to use another similar supply together with circuit components corresponding to components 2–7 as described above, with polarity reversals applied where necessary, to provide a supply of −72 kV so that a total of 144 kV can be applied between the cathode and the anode of the X-ray tube (not shown). Clearly the switch 7 and the corresponding component in the negative potential supply circuit arrangement have to be operated synchronously.

A practical system conveniently employs, as amplifier 4, a thermionic valve amplifier. A common cathode configuration is suitable for the positive voltage handling amplifier and a cathode follower output for the negative supply's amplifier. If each amplifier copes with 10 kV for 0.1 second, the energy involved in an exposure is 500 joules. Averaged over a five second rest period this amounts to 100 watts per amplifier. The switch 7 and its counterpart in the negative supply can conveniently be used to connect the grid to a high voltage through a resistor, causing the valve to bottom despite other influences.

The capacitor means 2 has been referred to as such because in practice it does not comprise a single capacitor, but many interconnected capacitors 22 as shown in FIG. 2. Each capacitor can conveniently comprise a General Electric capacitor type 86F247 which has a capacitance of 1900 μF and a working voltage of 450 V D.C. This component has a maximum leakage at 45° C. of 6 mA. The case dimensions are 3" diameter by 5¾ high. An array of 60 of these with their axes of symmetry parallel can be fitted into a container 30" diameter by 8" high. Such an array connected in series/parallel as shown in FIG. 2 provides a capacitor means with 126 μF capacity, a working voltage of 13,500 volts (15,000 volt surge) and a leakage of less than 12 mA at 45° C. To distribute the voltage equally between the pairs of capacitors 22, zener diode/resistor networks such as 23 can be utilised. Of course, a practical design does not attempt to achieve the full theoretical working voltage, but 12,000 volts using 400 volts zener diodes is considered safe to use. The worst case current in a zener diode under normal operation is the charging current, i.e. 30 mA, so 5 watt zener diodes should be used with series resistors of resistance 1 kΩ. The array could be housed in boxes shaped to minimise corona effect, as shown in FIG. 3. Six boxes 31 in series spaced off from each other on insulating columns 32 three inches long can withstand 72,000 volts and have a capacity of 21 μF (corresponding to EHT voltage of 144 kV.). In this case the compensating amplifier would only need to handle 5 kV peak. The total number capacitors is 720.

The portions of the arrays in the boxes are connected by leads 33 extending through insulating columns 34.

If the scan time were to change, only the current handling of the amplifier would change; the main power supply and capacitors would still be adequate so long as the time/current product for the exposure were maintained.

What I claim is:

1. An electrical power supply including: a source for supplying electrical energy at a constant current and at a desired potential; capacitor means, connected to the source to be changed thereform, for supplying a pulse, having a predetermined duration, of electrical energy at a rate in excess of the rate of supply by the source; an output terminal, connected to one side of the capacitor means, to which the pulse is supplied; and compensating means connected to the side of the capacitor means remote from the output terminal and responsive during the supply of the pulse to a drop in the voltage at the output terminal below a reference level to apply to the said side of the capacitor means remote from the output terminal a compensating voltage which varies oppositely to the variation in voltage across the capacitor means, to maintain the voltage at the output terminal substantially constant during the supply of the pulse.

2. A supply according to claim 1 including switching means for selecting the pulse supply period as the period of operation of the compensating means.

3. A supply according to claim 1, wherein the compensating means includes means for sensing the voltage at the output terminal and means for producing the compensating voltage in dependence upon the difference between the sensed voltage and the reference level, the output of the means for producing being connected to the said side of the capacitor means remote from the output terminal.

4. A supply according to claim 3, wherein the means for producing comprises an amplifier the output of which is connected to the said side of the capacitor means remote from the output terminal, and an input which is coupled to the sensing means.

5. A supply according to claim 4 further including a source of reference potential and wherein the amplifier is a differencing amplifier having a further input coupled to the source of reference potential.

* * * * *